US008334823B2

(12) United States Patent
Toyomura et al.

(10) Patent No.: US 8,334,823 B2
(45) Date of Patent: Dec. 18, 2012

(54) DISPLAY DEVICE AND DISPLAY DRIVING METHOD THEREFOR

(75) Inventors: Naobumi Toyomura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 81 days.

(21) Appl. No.: 13/064,576

(22) Filed: Apr. 1, 2011

(65) Prior Publication Data

US 2011/0316836 A1 Dec. 29, 2011

(30) Foreign Application Priority Data

Jun. 29, 2010 (JP) ..... 2010-147228

(51) Int. Cl.
*G09G 3/30* (2006.01)

(52) U.S. Cl. ..... 345/76; 345/211

(58) Field of Classification Search ..... 345/76, 345/77, 82, 204, 211, 212, 214, 690; 315/169.1–169.4; 313/500
See application file for complete search history.

(56) References Cited

U.S. PATENT DOCUMENTS

2004/0066357 A1* 4/2004 Kawasaki ..... 345/76
2009/0167652 A1 7/2009 Yamamoto et al.
2010/0026674 A1 2/2010 Araki

FOREIGN PATENT DOCUMENTS

JP 2009-157018 7/2009
JP 2010-038928 2/2010

* cited by examiner

*Primary Examiner* — Abbas Abdulselam
(74) *Attorney, Agent, or Firm* — Rader Fishman & Grauer, PLLC

(57) ABSTRACT

Disclosed herein is a display device, including: a pixel array in which pixel circuits each having a light emitting element, a driving transistor for applying a current corresponding to a gate-to-source voltage to the light emitting element connected to a source side by applying a drive voltage across a drain and a source, a sampling transistor for inputting a signal line voltage to a gate of the driving transistor by being caused to conduct, and a sustaining capacitor connected between the gate and the source of the driving transistor for sustaining a video signal voltage inputted thereto are disposed in a matrix; a signal selector; a drive control scanner; and a write scanner.

5 Claims, 10 Drawing Sheets

DISPLAY DEVICE AND DISPLAY DRIVING METHOD THEREFOR

BACKGROUND OF THE INVENTION

1. Field of the Invention

The present invention relates to a display device having a pixel array in which pixel circuits are disposed in a matrix, and a display driving method therefor. More particularly, the invention relates to a display device, using an organic electroluminescence element (organic EL element) as a light emitting element, and a display driving method therefor.

2. Description of the Related Art

An image display device using an organic EL element in a pixel has been developed. Since the organic EL element is a self-emission element, the organic EL element has an advantage that, for example, the visibility of an image is high, a backlight is unnecessary, a response speed is high, and the like as compared with the case of a liquid crystal display device. In addition, luminance levels (gradation) of the light emitting elements can be controlled in accordance with values of currents caused to flow through the light emitting elements, respectively (so-called current control type).

In the organic EL display device, similarly to the case of the liquid crystal display device, a simple matrix system and an active matrix type are known as a driving system thereof. Although the former is simple in configuration, the former involves a problem that it is difficult to realize a large-scaled and high-definition display device, and so forth. Therefore, at the present time, the active matrix system type organic EL display device is actively developing. This system is such that currents caused to flow through the light emitting elements provided inside the pixel circuits are controlled by active elements (in general, thin film transistors (TFTs)) provided inside the pixel circuits, respectively.

SUMMARY OF. THE INVENTION

Now, enhancement of display quality by dissolution of luminance unevenness for each pixel, and the like is required for a configuration of the pixel circuit using the organic EL element. The configuration and operation of the pixel circuit adapted to dissolve the luminance unevenness for each pixel by canceling dispersions of threshold voltages and mobilities of driving transistors in the pixel circuits have been variously proposed in order to realize a display panel which is especially excellent in uniformity.

The present invention has been made in order to solve the problems described above, and it is therefore desire to provide a display device in which a mobility correcting ability of a driving transistor for applying a current to a light emitting element can be enhanced, and a display driving method therefor.

In order to attain the desire described above, according to an embodiment of the present invention, there is provided a display device including: a pixel array in which pixel circuits each having a light emitting element, a driving transistor for applying a current corresponding to a gate-to-source voltage to the light emitting element connected to a source side by applying a drive voltage across a drain and a source, a sampling transistor for inputting a signal line voltage to a gate of the driving transistor by being caused to conduct, and a sustaining capacitor connected between the gate and the source of the driving transistor for sustaining a video signal voltage inputted thereto are disposed in a matrix; a signal selector for supplying a reference voltage, an intermediate voltage, and a video signal voltage as the signal line voltage to each of signal lines disposed in the pixel array in columns in a time division manner; a drive control scanner for giving a power source pulse to each of power source control lines disposed on the pixel array in rows, and applying a drive voltage to the driving transistor of the pixel circuit; and a write scanner for giving a scanning pulse to each of write control lines disposed on the pixel array in rows to control the sampling transistor of said pixel circuit, thereby causing out input of the signal line voltage to each of the pixel circuits to be carried out, in which for control within one emission cycle of the pixel circuit based on the scanning pulse, the write scanner causes the sampling transistor to conduct while the signal line voltage is set as the reference voltage in order to cause correction of a threshold of the driving transistor to be carried out for a non-emission period of time within the one emission cycle, controls the sampling transistor while the signal line voltage is set as the intermediate voltage in order to cause input of the video signal voltage to the pixel circuit and correction of a mobility of the driving transistor to be carried out after the correction of the threshold, thereby boosting a gate voltage of the driving transistor from the reference voltage up to a level not reaching the intermediate voltage, keeps the sampling transistor in a non-conduction state for a given period of time, and causes the sampling transistor to conduct while the signal line voltage is set as the video signal voltage.

According to another embodiment of the present invention, there is provided a display device including: a pixel array in which pixel circuits each having a light emitting element, a driving transistor for applying a current to the light emitting element, and a sampling transistor are disposed in a matrix; a signal selector for supplying a reference voltage, an intermediate voltage and a video signal voltage as a signal line voltage to each of signal lines disposed on the pixel array in a time division manner; and a write scanner for controlling the sampling transistor of the pixel circuit, in which the write scanner causes the sampling transistor to conduct while the signal line voltage is set as the reference voltage, causes the sampling transistor to conduct while the signal line voltage is set as the intermediate voltage, keeps the sampling transistor in a non-conduction state, and causes the sampling transistor to conduct while the signal line voltage is set as the video signal voltage.

According to still another embodiment of the present invention, there is provided a display driving method for a display device including: a pixel array in which pixel circuits each having a light emitting element, a driving transistor for applying a current corresponding to a gate-to-source voltage to the light emitting element connected to a source side by applying a drive voltage across a drain and a source, a sampling transistor for inputting a signal line voltage to a gate of the driving transistor by being caused to conduct, and a sustaining capacitor connected between the gate and the source of the driving transistor for sustaining a video signal voltage inputted thereto are disposed in a matrix; a signal selector for supplying a reference voltage, an intermediate voltage, and a video signal voltage as the signal line voltage to each of signal lines disposed on the pixel array in columns in a time division manner; a drive control scanner for giving a power source pulse to each of power source control lines disposed on the pixel array in rows, and applying a drive voltage to the driving transistor of the pixel circuit; and a write scanner for giving a scanning pulse to each of write control lines disposed on the pixel array in rows to control the sampling transistor of the pixel circuit, thereby causing out input of the signal line voltage to each of the pixel circuits to be carried out, the display driving method including the steps of: causing the sampling transistor to conduct while the signal line voltage is set as the reference voltage in order to cause correction of a threshold of the driving transistor to be carried out for a non-emission period of time within one emission cycle of the pixel circuit; and keeping the sampling transistor in a non-conduction state for a given period of time after the sampling transistor is controlled while the signal line voltage is set as the intermediate voltage in order to cause out input of the video signal voltage to the pixel circuit, and correction of a mobility of the driving transistor to be carried out after correction of the threshold, thereby boosting a gate voltage of the driving transistor from the reference voltage to a level not reaching the intermediate voltage, and then causing the sampling transistor to conduct while the signal line voltage is set as the video signal voltage in accordance with a scanning pulse outputted from the write scanner.

In the embodiments of the present invention, when the input of the video signal voltage to the pixel circuit and the correction of the mobility of the driving transistor are caused to be carried out after completion of the correction of the threshold, firstly, the intermediate voltage is written, and thereafter, the video signal voltage corresponding to the gradation for emission is written. In such a manner, the operation is carried out in accordance with the two-stage write system. The intermediate voltage is an optimal correction voltage corresponding to the video signal.

In the two-stage write system, firstly, the intermediate voltage is written from the signal line to a gate node of the driving transistor. Next, the gate node of the driving transistor is separated from the signal line, thereby causing the bootstrapping operation (for boosting the voltages at the gate node and a source node of the driving transistor) to be carried out. After that, the video signal voltage is written from the signal line to the gate node of the driving transistor.

Here, when the intermediate voltage is written, the operation for writing the intermediate voltage is ended before the voltage at the gate node of the driving transistor reaches the intermediate voltage. As a result, the function of correcting the mobility during the bootstrapping operation is enhanced.

As set forth hereinabove, according to the present invention, when the two-stage write system is adopted for the purpose of causing the input of the video signal voltage, and the correction of the mobility of the driving transistor to be carried out, it is possible to enhance the mobility correcting ability for the bootstrap period of time. As a result, the intermediate voltage for obtaining the necessary mobility correcting ability can be set at a low level, and thus it is possible to realize the power saving.

DETAILED DESCRIPTION OF THE PREFERRED EMBODIMENTS

The preferred embodiments of the present invention will be described in detail hereinafter with reference to the accompanying drawings. It is noted that the description will be given in accordance with the following order.

[1. Configurations of Display Device of First embodiment and Pixel Circuit]

[2. Operation of Pixel Circuit Considered in Course of Reaching the Invention (Comparative Example)]

[3. First example]

[4. Second example]

[5. Second Embodiment (Display Driving Method for Display Device)]

1. Configurations of Display Device of Embodiments and Pixel Circuit

Figure 1:
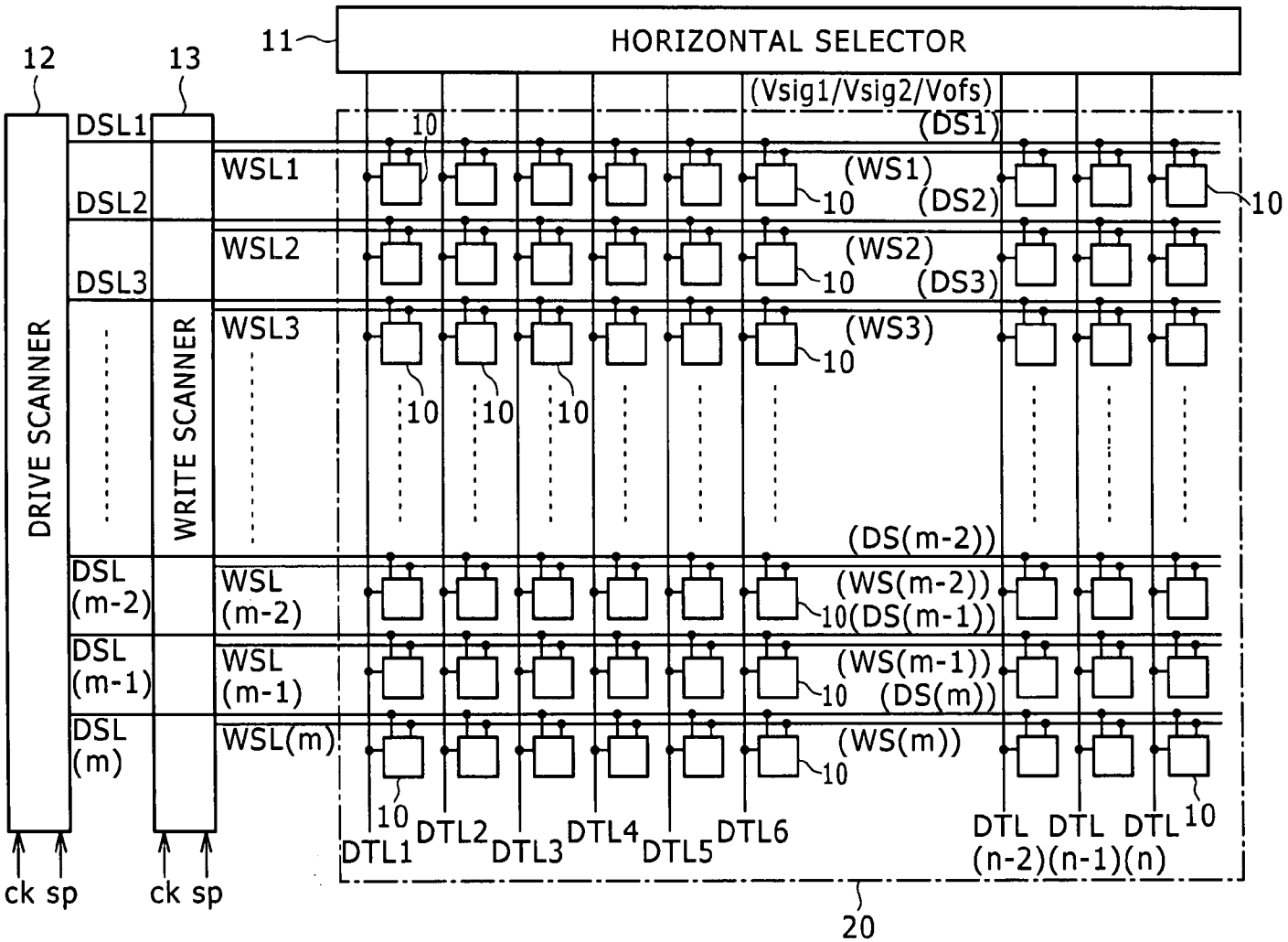
FIG. 1 is a block diagram, partly in circuit, explaining a configuration of a display device according to a first embodiment of the present invention.

FIG. 1 shows a configuration of an organic EL display device according to a first embodiment of the present invention.

The organic EL display device uses an organic EL element as a light emitting element, and includes pixel circuits 10 for carrying out emission drive in accordance with an active matrix system.

As shown in FIG. 1, the organic EL display device has a pixel array 20 in which a large number of pixel circuits 10 are disposed both in a column direction and in a row direction (m row×n column) in a matrix. It is noted that each of the pixel circuits 10 composes an emission pixel corresponding to any one of Red (R), Green (G) and Blue (B), and the pixel circuits 10 corresponding to R, G and B, respectively, are disposed in accordance with predetermined regulations, thereby configuring a color display device.

The organic EL display device includes a horizontal selector 11, a drive scanner 12, and a write scanner 13 in terms of a configuration for emission drive for the pixel circuits 10.

In addition, signal lines DTL1, DTL2, . . . , DTL(n) which are selected by the horizontal selector 11 and through which voltages corresponding to signal values (gradation values) of luminance signals as display data are supplied to the pixel circuits 10, respectively, are disposed on the pixel array 20 in the column direction. The signal lines DTL1, DTL2, . . . , DTL(n) are disposed by the number of columns (n columns) of the pixel circuits 10 disposed in a matrix on the pixel array 20.

In addition, write control lines WSL1, WSL2, . . . , WSL (m), and power source control lines DSL1, DSL2, . . . , DSL(m) are disposed on the pixel array 20 in the row direction. The write control lines WSL and the power source control lines DSL are each disposed by the number of rows (m rows) of the pixel circuits 10 disposed in a matrix in the pixel array 20.

The write control lines WSL (ESL1 to WSL(m)) are driven by the write scanner 13.

The write scanner 13 successively supplies scanning pulse WS (WS1, WS2, . . . , WS(m)) to the write control lines WSL1 to WSL(m) disposed in rows at set predetermined timings, respectively, thereby scanning the pixel circuits 10 in rows in a line-sequential manner.

The power source lines DSL (DSL1 to DSL(m)) are driven by the drive scanner 12. The drive scanner 12 supplies power source pulses DS (DS1, DS1, . . . , DS(m)) to the power source control lines DSL1 to DSL(m) disposed in rows, respectively, in accordance with the line-sequential scanning by the write scanner 13. Each of the power source pulses DS (DS1, DS2, . . . , DS(m)) is set as a pulse voltage in which two values of a drive voltage Vcc and an initial voltage Vini are switched over to each other.

It is noted that the drive scanner 12 and the write scanner 13 set timings for the power source pulses DS and the scanning pulses WS in accordance with a clock ck and a start pulse sp.

The horizontal selector 11 supplies signal line voltages as input signals to the respective pixel circuits 10 to the signal lines DTL1, DTL2, . . . disposed in the column direction, respectively, in accordance with the line-sequential scanning by the write scanner 13. In the first embodiment, the horizontal selector 11 supplies a reference voltage Vofs used for the threshold correction, an intermediate voltage Vsig1 used for mobility correction, and a video signal voltage Vsig2 as a voltage corresponding to the gradation based on video data as signal line voltages to the signal lines DTL1, DTL2, . . . , DTL(m), respectively, in a time division manner.

It is noted that in the organic EL display device of the first embodiment, an example of a signal selector described in the appended claims is the horizontal selector 11, an example of a drive control scanner described therein is the drive scanner 12, and an example of a write scanner described therein is the write scanner 13.

Figure 2:
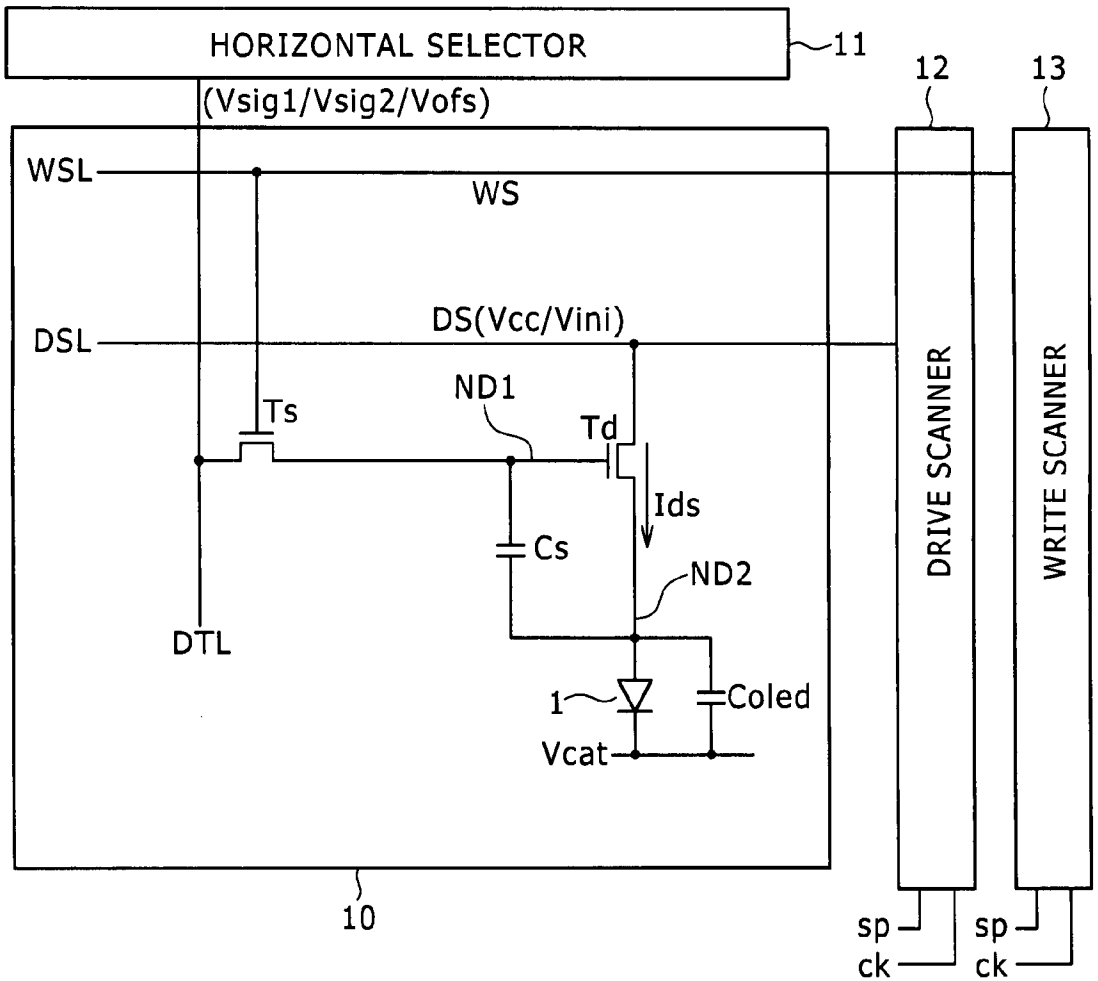
FIG. 2 is a circuit diagram showing a configuration of a pixel circuit in the display device according to the first embodiment of the present invention.

FIG. 2 shows an example of a configuration of the pixel circuit 10 in the organic EL display device of the first embodiment. The pixel circuits 10 are disposed in a matrix like the pixel circuits 10 in the configuration of FIG. 1.

It is noted that in FIG. 2, only one pixel circuit 10 disposed in a portion in which the signal line DTL, and the write control line WSL and the power source control line DSL intersect with each other is shown for the sake of simplicity.

The pixel circuit 10 is composed of an organic EL element 1 as a light emitting element, a sustaining capacitor Cs, a sampling transistor Ts, and a drive transistor Td. It is noted that a capacitor Coled is a parasitic capacitor parasitic in the organic EL element 1.

Each of the sampling transistor Ts and the drive transistor Td is composed of an n-channel Thin Film Transistor (TFT).

The sustaining capacitor Cs is connected in one terminal thereof to a source terminal (a node ND2) of the driving transistor Td, and is connected in the other terminal thereof to a gate terminal (a node ND1) of the driving transistor Td.

A drain terminal of the driving transistor Td is connected to the power source control line DSL corresponding to the row to which the pixel circuit 10 concerned belongs.

The organic EL element 1, for example, having a diode structure is used as the light emitting element of the pixel circuit 10, and includes an anode terminal and a cathode terminal. The anode terminal of the organic EL element 1 is connected to the source terminal of the driving transistor Td, and the cathode electrode of the organic EL element 1 is connected to a predetermined wiring (having a cathode voltage Vcat set thereon).

A source terminal and a drain terminal of the sampling transistor Ts are connected in series between the signal line DTL and the gate terminal (the node ND1) of the driving transistor Td.

Therefore, a configuration is adopted such that when the sampling transistor Ts is caused to conduct, a signal line voltage (suitable one of the video signal Vsig2, the intermediate voltage Vsig1 or the reference voltage Vofs) of the signal line DTL is inputted to the gate terminal of the drive transistor Td.

A gate terminal of the sampling transistor Ts is connected to the write control line WSL corresponding to the row to which the pixel circuit 10 concerned belong.

Emission driving for the organic EL element 1 is basically described as follows.

At a timing at which the video signal voltage Vsig2 is applied to the signal line DTL, the sampling transistor Ts is caused to conduct in accordance with a scanning pulse WS supplied thereto from the write scanner 13 through the write control line WSL. As a result, the video signal voltage Vsig2 is written from the signal line DTL to the sustaining capacitor Cs.

The driving transistor Td causes a current Ids to flow through the organic EL element 1 in accordance with the supply of a current from the power source control line DSL to which a drive voltage Vcc is supplied by the drive scanner 12, thereby causing the organic EL element 1 to emit a light.

At this time, the current Ids gets a value (a value corresponding to a voltage sustained in the sustaining capacitor Cs) corresponding to a gate-to-source voltage Vgs of the driving transistor Td. Also, the organic EL element 1 emits a light at a luminance corresponding to this current value.

In a word, in the case of the pixel circuit 10, the video signal voltage Vsig2 from the signal line DTL is written to the sustaining capacitor Cs, thereby changing the voltage applied to the gate terminal of the driving transistor Td. As a result, the value of the current caused to flow through the organic EL element 1 is controlled to obtain a gradation for emission.

Since the driving transistor Td is designed so as to usually operate in a saturated region, the driving transistor Td becomes a constant current source having a value expressed by Expression (1):

$$Ids=(1/2)\cdot\mu\cdot(W/L)\cdot Cox\cdot(Vgs-Vth)^2 \quad (1)$$

where Ids represents a current caused to flow between a drain terminal and a source terminal of a transistor operating in a saturated region, μ represents a mobility, W represents a channel width, L represents a channel length, Cox represents a gate capacitance, and Vth represents a threshold voltage of the driving transistor Td.

As apparent from Expression (1), in the saturated region, the drain current Ids is controlled by the gate-to-source voltage Vgs of the driving transistor Td. Since the gate-to-source voltage Vgs is held constant, the driving transistor Td operates as the constant current source, and thus can cause the organic EL element to emit the light at a given luminance.

As described above, basically, the operation for writing the video signal voltage (gradation value) Vsig2 to the sustaining capacitor Cs of the pixel circuit 10 is carried out four each of a frame periods of time, whereby the gate-to-source voltage Vgs of the driving transistor Td is determined in accordance with the gradation with which an image is to be displayed.

Also, the driving transistor Td operates in the saturated region, thereby functioning as the constant current source for the organic EL element 1. Thus, the current corresponding to the gate-to-source voltage Vgs of the driving transistor Td is caused to flow through the organic EL element 1, whereby in the organic EL element 1, the emission is carried out at the luminance corresponding to the gradation value of the video signal for each of the frame periods of time.

2. Operation of Pixel Circuit Considered in Course of Reaching the Invention

Comparative Example

Here, for understanding the present invention, a description will be given with respect to an operation of a pixel circuit considered in the course of reaching the present invention. This operation is a circuit operation containing a threshold correcting operation and a mobility correcting operation for compensating for the uniformity deterioration due to dispersions of the thresholds and mobilities of the driving transistors Td in the pixel circuits 10. Also, this comparative example is an example in which in particular, when the input of the video signal voltage to the pixel circuit, and the correction of the mobility of the driving transistor are carried out after completion of the threshold correction, a two-stage write operation is carried out in which firstly, the intermediate voltage is written, and thereafter, the video signal voltage corresponding to the gradation for the emission is written.

It is noted that with regard to the threshold correcting operation, an example is adopted such that fractional threshold value correction is carried out fractionally plural times within a period of time of one emission cycle.

It is noted that although in the pixel circuit operation, the threshold correcting operation and mobility correcting operation per se have been carried out, the necessity thereof will now be described in brief.

For example, in a pixel circuit using a polysilicon TFT and the like, the threshold voltage Vth of the driving transistor Td, and the mobility p of a semiconductor thin film composing a channel of the driving transistor Td are changed with time in some cases. In addition, the transistor characteristics such as the threshold voltage Vth and the mobility μ may differ every pixel due to the dispersion of the manufacturing processes.

When the threshold voltage Vth and the mobility μ of the driving transistor Td differ every pixel, the dispersion is caused to in the value of the current caused to flow through the driving transistor Td every pixel. To this end, even if the same video signal value (the video signal voltage Vsig2) is given to all the pixel circuits 10, the dispersion for each pixel is caused in the emission luminance of the organic EL element 1. As a result, the uniformity of the picture is impaired.

From this, the function of correcting the fluctuations of the threshold voltage Vth and the mobility μ is given in the pixel circuit operation.

Figure 3:
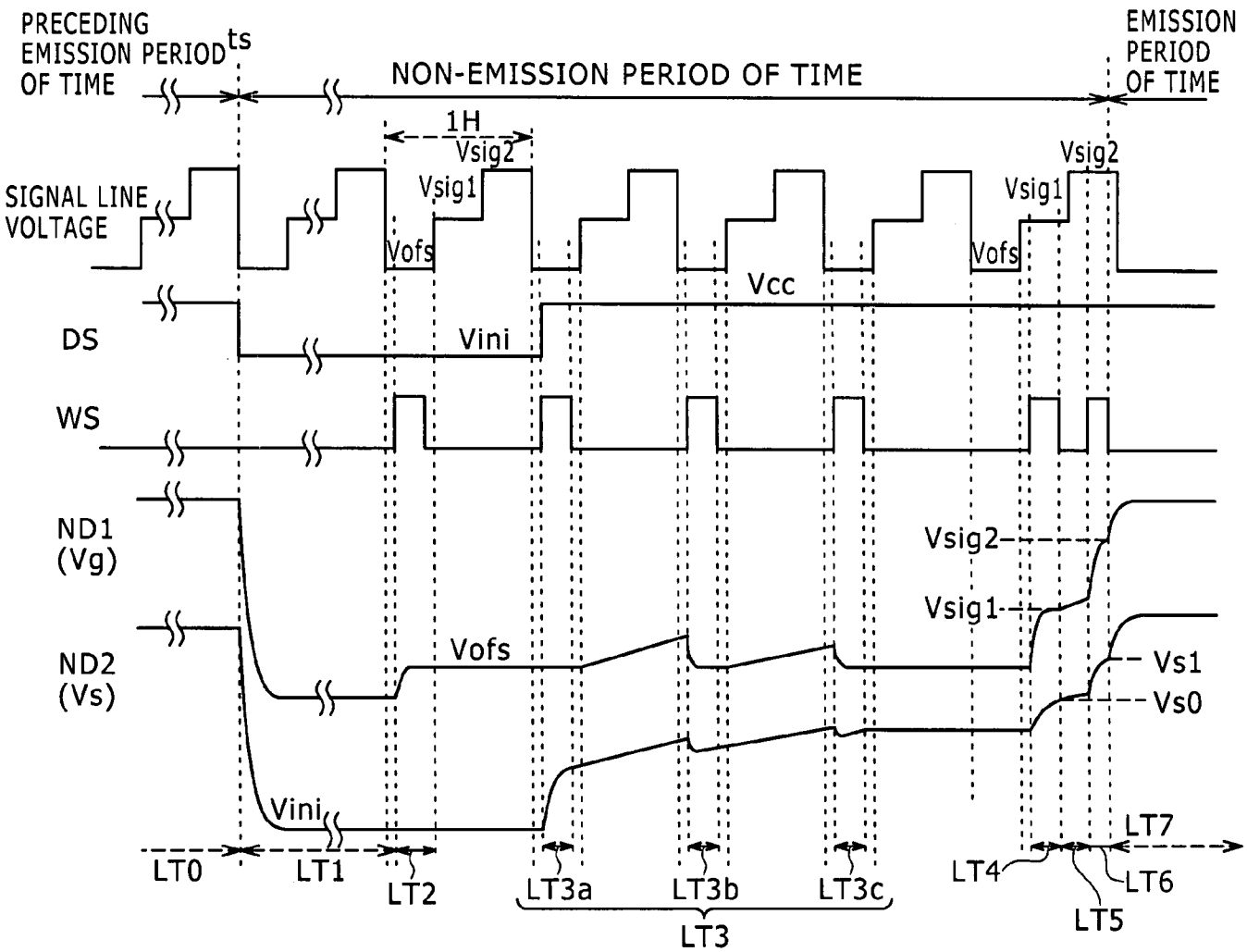
FIG. 3 is a timing chart explaining an operation of a pixel circuit of a comparative example.

FIG. 3 shows a timing chart of the operation for one emission cycle (one frame period of time) of the pixel circuit 10 as the comparative example.

FIG. 3 shows the signal line voltage which the horizontal selector 11 gives to the signal line DTL. In the case of this operation example, the horizontal selector 11 gives a pulse voltage of suitable one of the reference voltage Vofs, the intermediate voltage Vsig1, or the video signal voltage Vsig2 as the signal line voltage to the signal line DTL for one horizontal period of time (1 H).

In addition, FIG. 3 shows the power source pulse DS which is supplied from the drive scanner 12 through the power source control line DSL. Either the drive voltage Vcc or the initial voltage Vini is given as the power source pulse DS.

In addition, FIG. 3 shows the scanning pulse WS which is given to the gate terminal of the sampling transistor Ts through the write control line WSL by the write scanner 13. The n-channel sampling transistor Ts is caused to conduct when the scanning pulse WS is set at an H level, and is kept in a non-conduction state when the scanning pulse WS is set at an L level.

Also, FIG. 3 shows changes of the gate voltage Vg and the source voltage Vs of the driving transistor Td as voltages at the nodes ND1 and ND2 shown in FIG. 2.

A time point ts in the timing chart of FIG. 3 becomes a start timing of one cycle for which the organic EL element 1 as the light emitting element is driven to emit the light, for example, one frame period of time for image display.

Figure 4A:
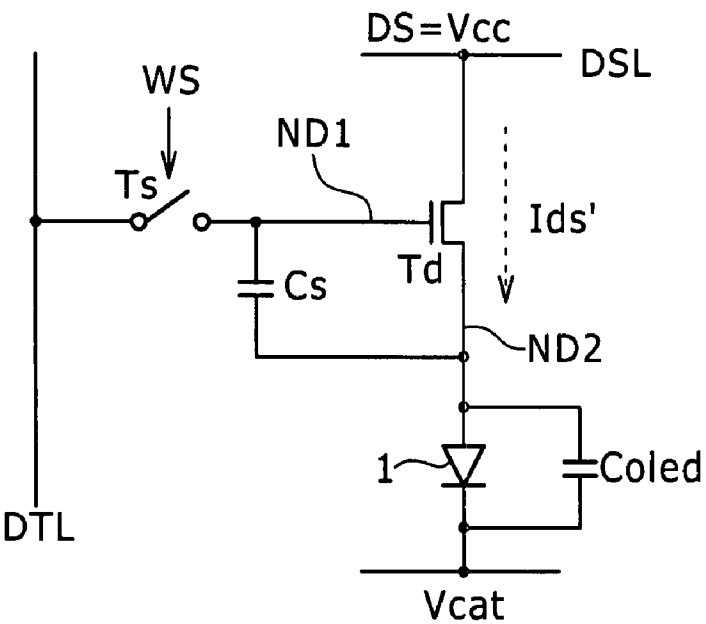
FIGS. 4A and 4B are equivalent circuit diagrams in processes of an emission operation in one cycle of the pixel circuit, respectively.

Before the time point ts is reached (a period LT0 of time), the emission for the preceding frame is carried out. FIG. 4A shows an equivalent circuit for the period LT0 of time.

That is to say, an emission state of the organic EL element 1 is a state in which the power source DS is set as the drive voltage Vcc, and thus the sampling transistor Ts is held in an OFF state. At this time, since the driving transistor Td is set so as to operate in the saturated region, a current Ids' caused to flow through the organic EL element 1 obtains the value expressed by Expression (1) in accordance with the gate-to-source voltage Vgs of the driving transistor Td.

An operation for the emission for the present frame is started at the time point ts.

Figure 4B:
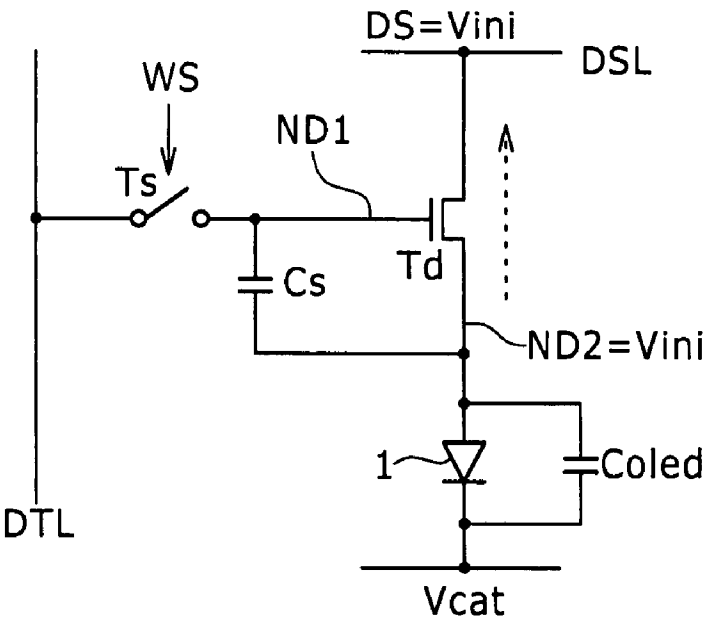

Firstly, a relationship of the power source pulse DS=the initial voltage Vini is set. FIG. 4B shows an equivalent circuit for a period LT1 of time.

At this time, the initial voltage Vini is smaller than the sum of a threshold voltage Vthel and the cathode voltage Vcat of the organic EL element 1. In a word, by establishing a relationship of Vini≦(Vthel+Vcat), the organic EL element 1 is quenched and a non-emission period of time is started. At this time, the power source control line DSL electrically agrees with the source terminal of the driving transistor Td. In addition, the anode terminal (the node ND2) of the organic EL element 1 is changed at the initial voltage Vini.

Figure 5A:
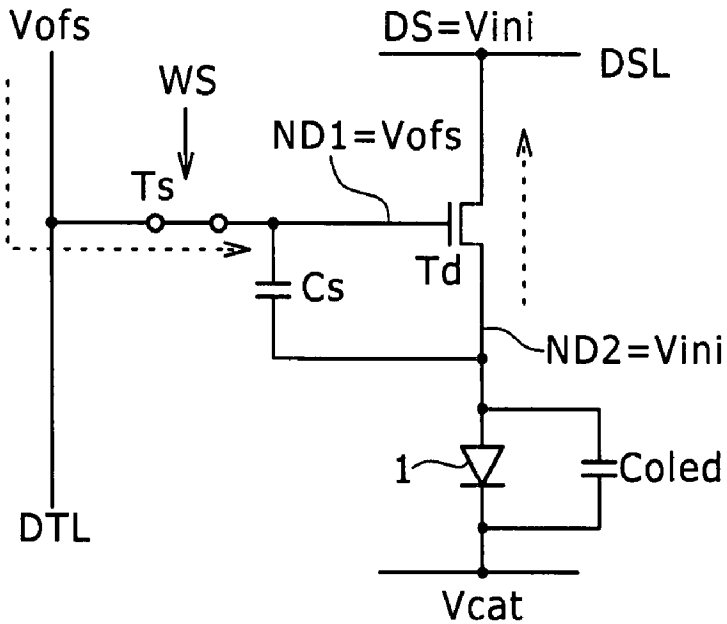
FIGS. 5A and 5B are equivalent circuit diagrams in the processes of the emission operation in one cycle of the pixel circuit, respectively.

After a lapse of a given period of time, a preparation for the threshold correction is carried out (a period LT2 of time). An equivalent circuit is shown in FIG. 5A.

That is to say, for the period LT2 of time, when the voltage of the signal line DTL is set as the reference voltage Vofs, the scanning pulse WS is set at the H level, and thus the sampling transistor Ts is turned ON. For this reason, the voltage at the gate terminal (the node ND1) of the driving transistor Td is set as the reference voltage Vofs.

Also, the gate-to-source voltage Vgs of the driving transistor Td becomes equal to (Vofs−Vini).

The threshold correcting operation cannot be carried out unless (Vofs−Vini) is larger than the threshold voltage Vth of the driving transistor Td. Therefore, both the initial voltage Vini and the reference voltage Vofs are set so that a relationship of (Vofs−Vini)>Vth is established.

That is to say, for the preparation for the threshold correction, the gate-to-source voltage Vgs of the driving transistor Td is made sufficiently larger than the threshold voltage Vth of the driving transistor Td.

Subsequently, the threshold correction (Vth correction) is carried out. In this case, an example is adopted such that the threshold correction is carried out three times for a period LT3*a* of time to a period LT3*c* of time.

Firstly, first round of the threshold correction (Vth correction) is carried out for the period LT3*a* of time.

Figure 5B:
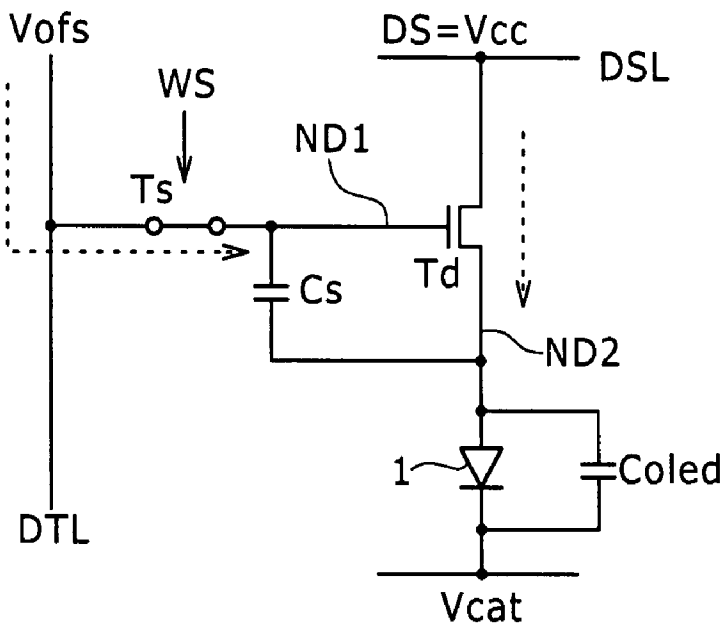

In this case, at a timing at which the signal line voltage is set as the reference voltage Vofs, the write scanner 13 sets the scanning pulse WS at the H level, and the drive scanner 12 sets the power source pulse DS as the drive voltage Vcc. An equivalent circuit is shown in FIG. 5B. In this case, however, the anode terminal (the node ND2) of the organic EL element 1 electrically agrees with the source terminal of the driving transistor Td, and the current is caused to flow through the organic EL element 1. To this end, the voltage at the source node (the node ND2) rises while the voltage at the gate terminal (the node ND1) of the driving transistor Td is fixedly held as the reference voltage Vofs.

The current of the driving transistor Td is used to charge both the sustaining capacitor Cs and the capacitor Coled as long as the anode voltage (the voltage at the node ND2) of the organic EL element 1 is equal to or lower than (Vcat+Vthel) (the threshold voltage of the organic EL element 1)). The wording "as long as the anode voltage of the organic EL element 1 is equal to or lower than (Vcat+Vthel)" means that a leakage current of the organic EL element 1 is sufficiently smaller than the current caused to flow through the driving transistor Td.

For this reason, the voltage at the node ND2 (the source voltage of the driving transistor Td) rises with time.

It can be said that this threshold correction is basically an operation for setting the gate-to-source voltage of the driving transistor Td at the threshold voltage Vth. Therefore, all it takes is that the source voltage of the driving transistor Td rises until the gate-to-source voltage of the driving transistor Td becomes equal to the threshold voltage Vth.

However, the voltage at the gate node can be fixed to the reference voltage Vofs only for a period of time for which a relationship of the signal line voltage=Vofs is established. Then, enough time for the source voltage to rise until the gate-to-source voltage reaches the threshold voltage Vth is not taken in one threshold correcting operation depending on the frame rate or the like. Then, the threshold correction is fractionally carried out plural times.

For this reason, before the signal line voltage is changed from the reference voltage Vofs to the intermediate voltage Vsig1, the threshold correction is ended for the period LT3*a* of time. That is to say, the write scanner 13 temporarily sets the scanning pulse WS at the L level, thereby turning OFF the sampling transistor Ts.

At this time, since both the gate and source voltages are in a floating state, the current is caused to flow between the drain terminal and the source terminal in accordance with the gate-to-source voltage Vgs, thereby carrying out the bootstrapping operation. That is to say, as shown in FIG. 3, both the gate voltage and the source voltage rise.

It is noted that at this time, the organic EL element 1 does not emit the light because the organic EL element 1 is biased in the reverse direction as long as a relationship of (the voltage at the node ND2) (the threshold voltage Vthel of the organic EL element 1)+(the cathode voltage Vcat) is established.

Next, second round of the threshold correction is carried out for the period LT3*b* of time. That is to say, when a relationship of the signal line voltage=the reference voltage Vofs is established, the write scanner 13 sets the scanning pulse WS at the H level again, thereby turning ON the sampling transistor Ts. As a result, a relationship of the gate voltage of the driving transistor Td=the reference voltage Vofs is established, and thus the source voltage rises.

In addition, the threshold correcting operation is paused. It is noted that since in the second round of the threshold correction, the gate-to-source voltage of the driving transistor Td becomes closer to the threshold voltage Vth, a bootstrap amount in the second round of a pausing period of time becomes shorter than that in the first round of the pausing period of time.

Also, for the period LT3*c* of time, third round of the threshold correction is carried out.

Also, finally, the gate-to-source voltage Vgs of the driving transistor Td becomes equal to the threshold voltage Vth.

At this time, a relationship of the source voltage (the anode voltage at the node ND2 of the organic EL element 1)=Vofs−Vth≦Vcat+Vthel is established.

In the case of FIG. 3, after a lapse of the period LT3*c* of time for the third round of the threshold correction, the scanning pulse WS is set at the L level to turn OFF the sampling transistor Ts, thereby completing the threshold correcting operation.

Subsequently, for periods LT4, LT5, LT6 of time, the video signal voltage writing and the mobility correction using the two-stage write system are carried out.

Firstly, for the period LT4 of time, when the signal line DTL is held as the intermediate voltage Vsig1, the write scanner 13 sets the scanning pulse WS at the H level, thereby turning ON the sampling transistor Ts. The intermediate voltage Vsig1 is an optical correction voltage corresponding to the video signal voltage Vsig2.

Figure 6B:
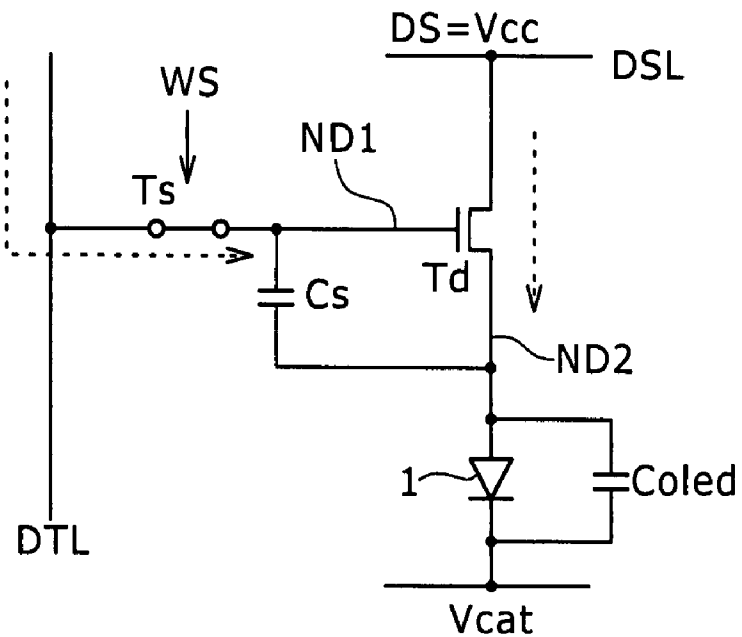
FIGS. 6A and 6B are equivalent circuit diagrams in the processes of the emission operation in one cycle of the pixel circuit, respectively.
Figure 6A:
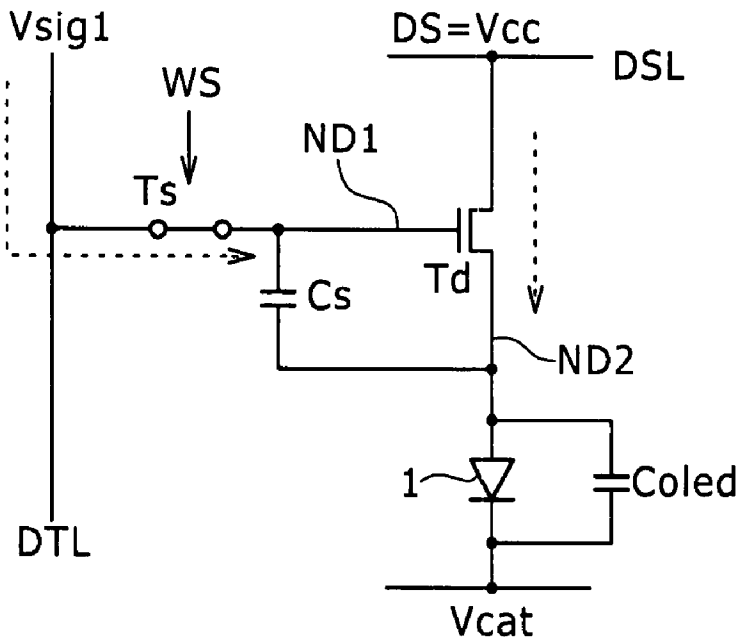

An equivalent circuit is shown in FIG. 6A. Although the gate voltage (at the node ND1) of the driving transistor Td becomes equal to the intermediate voltage Vsig1, since the current is caused to flow from the power source control line DSL, the source voltage (at the node ND2) rises with time.

At this time, when the source voltage (at the node ND2) of the driving transistor Td does not exceed the sum of the threshold voltage Vthel and the cathode voltage Vcat of the organic EL element 1 (the leakage current of the organic EL element 1 is sufficiently smaller than the current caused to flow through the driving transistor Td), the current of the driving transistor Td is used to charge both the sustaining capacitor Cs and the parasitic capacitor Colede.

Also, at this time, since the threshold correcting operation for the driving transistor Td is completed, the current caused to flow from the driving transistor Td becomes a current in which the mobility μ is reflected. Specifically, in the case of the driving transistor Td having the large mobility μ, a current amount at this time is large, and the rising of the source voltage (at the node ND2) is rapid. Contrary to this, when the mobility μ is small, the current amount is small and the rising of the source voltage (ND2) is slow.

Figure 9A:
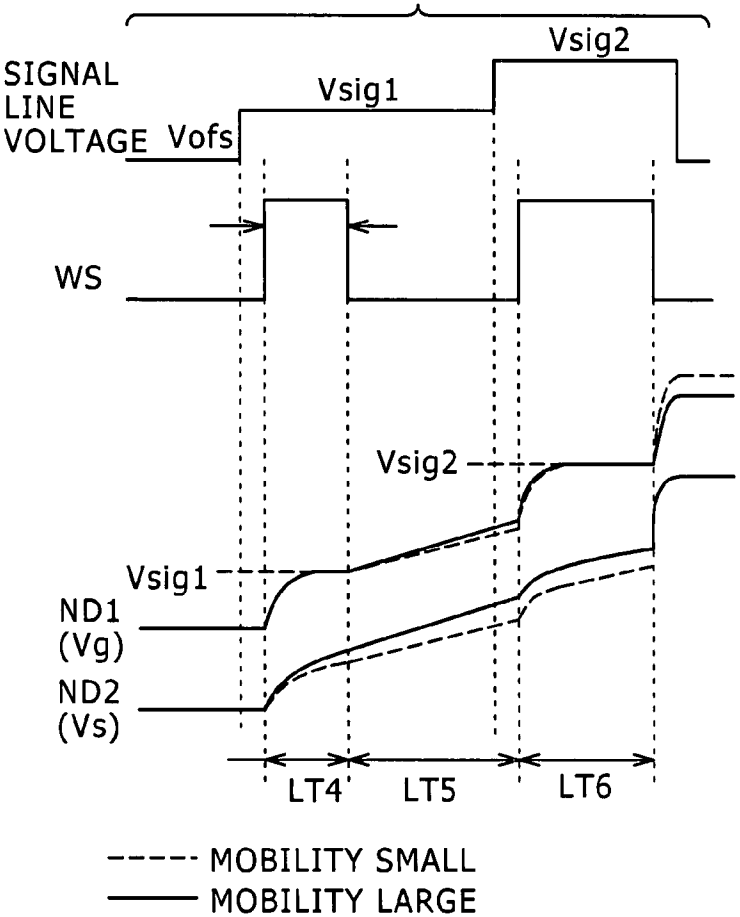
FIGS. 9A and 9B are timing charts explaining mobility correction in the first example, respectively.

It is noted that in FIG. 9A, with regard to the rising of the source voltage for the period LT4 of time, the case of the large mobility μ is indicated by a solid line, and the case of the small mobility μ is indicated by a broken line.

In such a manner, after the sampling transistor Ts is turned ON, the source voltage of the driving transistor Td rises. Also, when the scanning pulse WS is set at the L level, thereby turning OFF the sampling transistor Ts, as shown in FIG. 3, the source voltage Vs becomes a voltage Vs0 in which the mobility μ is reflected. The gate-to-source voltage Vgs of the driving transistor Td becomes equal to (Vsig1−Vs0), thereby correcting the mobility μ.

For the period LT5 of time for which the sampling pulse WS is held at the L level and thus the sampling transistor Ts is held in the OFF state, the bootstrapping operation is carried out. An equivalent circuit is shown in FIG. 6B.

The bootstrapping operation becomes an operation in which the current corresponding to the gate-to-source voltage Vgs described above is caused to flow between the drain terminal and the source terminal to cause the voltage at the node ND2 to rise, and the voltage at the node ND1 is also caused to rise through the sustaining capacitor Cs.

Figure 7B:
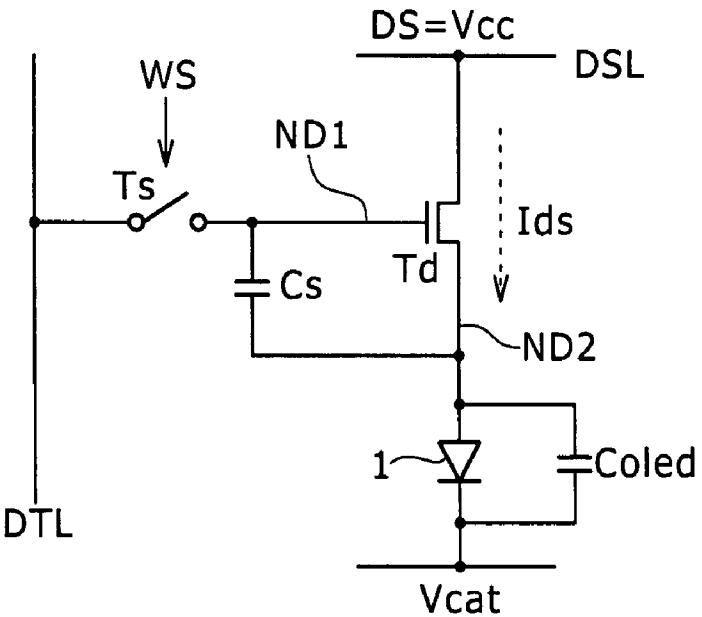
FIGS. 7A and 7B are equivalent circuit diagrams in the processes of the emission operation in one cycle of the pixel circuit, respectively.
Figure 7A:
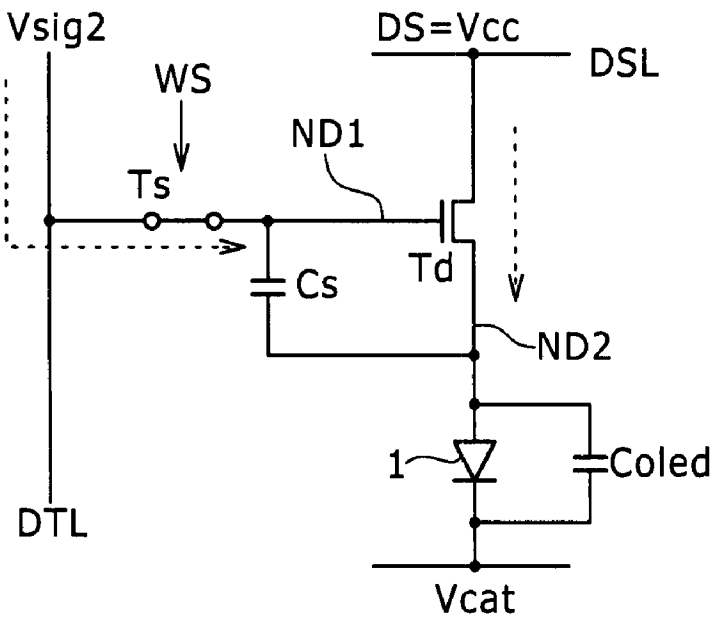

Next, when the voltage of the signal line DTL is held at a video signal voltage Vsig2 for the period LT6 of time, the scanning pulse WS is held at the H level, thereby turning N the sampling transistor Ts again. An equivalent circuit is shown in FIG. 7A.

As a result, the source voltage (at the node ND2) of the driving transistor Td rises, and becomes a voltage Vs1 in which the mobility μ is reflected at a time point at which the sampling transistor Ts is turned OFF.

Here, attention is paid to that the voltage at the node ND1 rises by carrying out the bootstrapping operation described above.

As shown in FIG. 9A, as the mobility μ is larger, the voltage at the node ND1 becomes high at a time point of end of the period LT5 of time (right before the rising of the video signal voltage Vsig).

For this reason, an amplitude of the write signal when of the video signal voltage Vsig is written becomes small.

In a word, by carrying out the bootstrapping operation, as the mobility μ is larger, Vgs=Vsig2−Vs1 after the video signal voltage Vsig2 is written becomes small.

As can be seen from FIG. 9A, the gate-to-source voltage Vgs of the driving transistor Td at a time point of end of the period LT6 of time for which the video signal voltage Vsig2 is written is small when the mobility μ is large, and is large when the mobility μ is small.

As a result, the same current can be supplied to the organic EL element 1 irrespective of small and large of the mobility μ.

Finally, for the period LT7 of time, the sampling pulse is set at the L level to turn OFF the sampling transistor Ts, thereby completing the writing operation. As a result, the organic EL element 1 is caused to emit the light. An equivalent circuit is shown in FIG. 7B.

In this case, the current Ids corresponding to the gate-to-source voltage Vgs of the driving transistor Td is caused to flow, the voltage at the node ND2 rises up to a voltage at which the current Ids is caused to flow through the organic EL element 1, and the organic EL element 1 emits the light. At this time, the sampling transistor Td is held in the OFF state, and thus the voltage at the node ND1 similarly rises concurrently with the rising of the voltage at the node ND2. Therefore, the gate-to-source voltage Vgs of the driving transistor Td is held constant (bootstrapping operation).

As described above, in the pixel circuit 10, the operation for emission of the organic EL element 1 is carried out, including the threshold correcting operation and the mobility correcting operation as the emission driving operation for one cycle in one frame period of time.

By carrying out the threshold correcting operation, the current corresponding to the signal voltage Vsig can be given to the organic EL element 1 irrespective of the dispersion of the threshold voltages Vth of the driving transistors Td, the fluctuation of the threshold voltage Vth due to the variation with time, and the like in the pixel circuits 10. In a word, the dispersion of the threshold voltages Vth due to the manufacturing process or the variation with time can be canceled, the luminance unevenness or the like can be prevented from being generated on the picture, and thus the high image quality can be maintained.

In addition, since the drain current is fluctuated due to the mobility μ as well of the driving transistor Td, the image quality is reduced due to the dispersion of the driving transistor Td for each pixel circuit 10. However, by carrying out the mobility correcting operation, the source voltage Vs is obtained in accordance with small and large of the mobility μ of the driving transistor Td. As a result, since the gate-to-source voltage Vgs is adjusted so as to absorb the dispersion of the mobilities μ of the driving transistors Td in the pixel circuits 10, the reduction of the image quality due to the dispersion of the mobilities μ of the driving transistors Td is also canceled.

It is based on the request of speeding-up (high frequency promotion) of the display device that the threshold correcting operation is fractionally carried out plural times as the pixel circuit operation for one cycle.

Since the high frame rate promotion progresses, whereby an operating time of the pixel circuit becomes relatively short, it becomes difficult to ensure the continuous threshold correction period of time (the period of time for the signal line voltage=the reference voltage Vofs). In order to cope with such a situation, the threshold correcting operation is carried out in the time division manner as described above, whereby a period of time necessary as the threshold correction period of time is ensured, thereby causing the gate-to-source voltage Vgs of the driving transistor Td to converge to the threshold voltage Vth.

Now, when the two-stage write is carried out in the manner as described above, the following points are pointed out.

The intermediate voltage Vsig1 needs to get the optimal value in accordance with the video signal voltage Vsig2. For example, however, when the dispersion of the mobilities μ within a panel surface becomes large, the voltage value of the necessary intermediate voltage Vsig1 needs to be increased up to the high voltage value.

In the two-stage write system, a bootstrapping amount for the period LT5 of time is adjusted depending on the mobility μ. Also, the gate-to-source voltage Vgs after completion of the bootstrapping operation (right before writing of the video signal voltage Vsig2) is given a difference depending on the mobility μ, thereby realizing the mobility correction.

During the bootstrapping operation, the current corresponding to the gate-to-source voltage Vgs is caused to flow between the drain terminal and the source terminal to cause the voltages at the nodes ND2 and ND1 to rise. Here, when it is considered that the effective write voltage during the writing of the video signal voltage Vsig2 is adjusted, thereby carrying out the mobility correction, for the purpose of coping with the case of the large dispersion, it is necessary to be capable of increasing a difference between the source voltage and the gate voltage corresponding to the mobility μ right before the writing of the video signal voltage Vsig2 and thus a difference of the gate-to-source voltage Vgs at a time point of end of the writing of the video signal voltage Vsig2.

In order to attain this, the difference of the bootstrap amount corresponding to the mobility μ has to be increased, and thus it is thought to increase the difference of the gate-to-source voltage Vgs at a time point of start of the bootstrapping operation. Also, in order to attain this, it is only necessary to increase the intermediate voltage Vsig1 up to the high voltage, and to cause the voltage at the node ND1 (gate voltage) at a time point of end of the period LT4 of time to be made high.

However, when the intermediate voltage Vsig1 is set as being high to increase the dynamic range of the intermediate voltage Vsig1, the power consumption is increased along therewith.

3. First Example

Then, in the first embodiment of the present invention, even though the intermediate voltage Vsig1 is not made high, it is possible to cope with the wider mobility dispersion.

In a first example of the first embodiment, this is realized by shorting the period LT4 of time for which the intermediate voltage Vsig1 is written.

Figure 8:
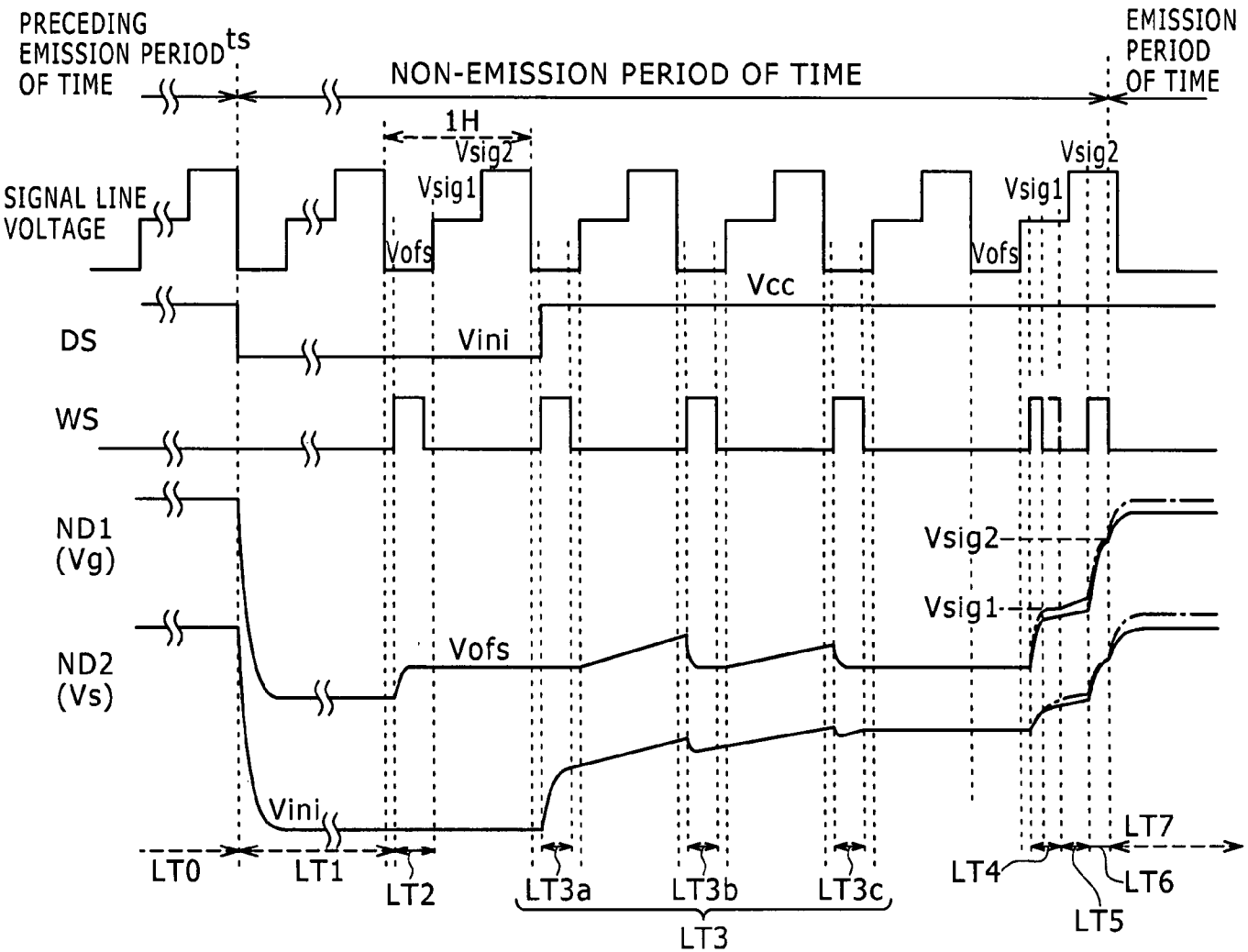
FIG. 8 is a timing chart explaining an operation of a pixel circuit according to a first example of the first embodiment of the present invention.

FIG. 8 shows the voltage of the signal line DTL, the power source pulse DS, the sampling pulse WS, and the voltages at the nodes ND1 and ND2 in the form of a timing chart of the operation for one cycle (one frame period of time) in a certain pixel circuit 10 similarly to the case of FIG. 3.

Note that, for comparison, with regard to the scanning pulse WS, and the voltages at the nodes ND1 and ND2, the waveforms of FIG. 3 are additionally indicated by chain lines, respectively. In this first example, waveforms of the scanning pulse WS, and the voltages at the nodes ND1 and ND2 are indicated by solid lines, respectively.

Since in the operation for one cycle shown in FIG. 8, the operations for the periods LT1, LT2, LT3 of time are the same as those shown in FIG. 3, a repeated description thereof is omitted here for the sake of simplicity.

The feature of the first example is that a period of time for which the intermediate voltage Vsig1 is written to be shortened as the period LT4 of time. That is to say, as shown in FIG. 8, for the purpose of providing the period LT4 of time, the H-level period of time of the scanning pulse WS outputted by the write scanner 13 is made shorter than that in the case of FIG. 3.

A time length of the period LT4 of time in this case becomes a time length set in such a way that the writing of the intermediate voltage Vsig1 is ended before the voltage at the node ND1 reaches the intermediate voltage Vsig1.

That is to say, in the first example, the write scanner 13 carries out the following control as the control within one emission cycle of the pixel circuit 10 based on the scanning pulse WS.

Firstly, for a non-emission period of time within one emission cycle, for carrying out the threshold correction for the driving transistor Td, while the voltage of the signal line DTL is set as the reference voltage Vofs, the sampling transistor Ts is caused to conduct (the periods LT3*a*, LT3*b* and LT3*c* of time).

After completion of the threshold correction, for the periods LT4, LT5 and LT6 of time, the input of the video signal voltage Vsig2 to the pixel circuit 10, and the mobility correction for the driving transistor Td are both caused to be carried out.

Firstly, for the period LT4 of time, while the voltage of the signal line DTL is set as the intermediate voltage Vsig1, the gate voltage of the driving transistor Td is caused to rise from the reference voltage Vofs to the level which does not reach the intermediate voltage Vsig1 by controlling the sampling transistor Ts. That is to say, while the voltage of the signal line DTL is set as the intermediate voltage Vsig1, after the write scanner 13 sets the scanning pulse WS at the H level to cause the sampling transistor Ts to conduct, the write scanner 13 sets the scanning pulse WS at the L level at a timing at which the voltage at the node ND1 does not reach the intermediate voltage Vsig1 to turn OFF the sampling transistor Ts, thereby completing the writing of the intermediate voltage Vsig1.

After that, for the period LT5 of time, the write scanner 13 holds the scanning pulse WS at the L level, thereby keeping the sampling transistor Ts in a non-conduction state for a given period of time. That is to say, the bootstrapping operation is carried out.

In addition, even after that, for the period LT6 of time, while the voltage of the signal line DTL is set as the video signal voltage Vsig2, the write scanner 13 sets the scanning pulse WS at the H level to cause the sampling transistor Ts to conduct, thereby writing the video signal voltage Vsig2.

Figure 9B:
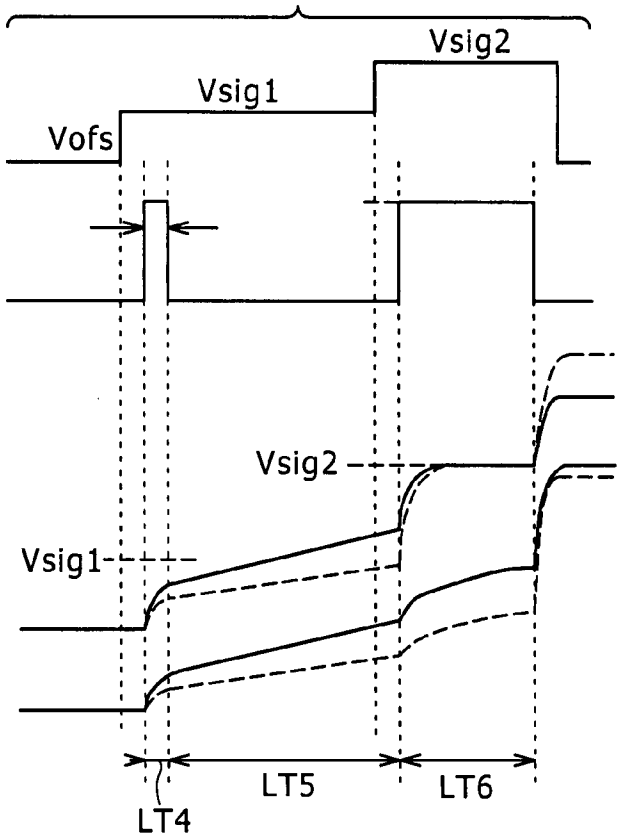

Waveforms for the periods LT4, LT5 and LT6 of time shown in FIG. 8 are shown in an enlarged style in FIG. 9B. Similarly to the case of FIG. 9A of the comparative example previously stated, the case of the large mobility μ is indicated by a solid line, and the case of the small mobility μ is indicated by a broken line.

Firstly, FIG. 9B shows that the operation for writing the intermediate voltage Vsig1 is ended at a time point at which the operation for writing the intermediate voltage Vsig1 is not perfectly carried out, in a word, at a time point at which the voltage at the node ND1 does not reach the intermediate voltage Vsig1.

The write scanner 13 does not wait up to a time point at which the voltage at the node ND1 reaches the intermediate voltage Vsig1, whereby the voltage at the node ND1 at a time point of start of the period LT5 of time differs depending on the mobilities p.

By carrying out such an operation, it is possible to further increase the difference in bootstrap amount between the case of the large mobility μ and the case of the small mobility μ in the bootstrapping operation for the period LT5 of time.

As a result, in the pixel circuit 10 having the large mobility μ, the bootstrap amount becomes large and the effective write voltage in the phase of write of the video signal voltage Vsig2 becomes smaller. On the other hand, in the pixel circuit 10 having the small mobility μ, the bootstrap amount becomes small and the effective write voltage in the phase of write of the video signal voltage Vsig2 becomes larger. As a result, the final currents caused to flow through the respective organic EL elements 1 can be made equal to one another irrespective of small and large of the mobility μ.

From the above operation, the width of the scanning pulse WS is shortened, and the write of the intermediate voltage Vsig1 is ended before the voltage at the node ND1 reaches the intermediate voltage Vsig1, whereby the mobility correcting function by the bootstrapping operation can be further enhanced.

Therefore, when the mobility correcting function is enhanced, thereby making it possible to cope with the case as well where the mobility dispersion is large, the intermediate voltage Vsig1 needs not to be set as the higher voltage value, and thus an increase in power consumption is not caused.

4. Second Example

Figure 10A:
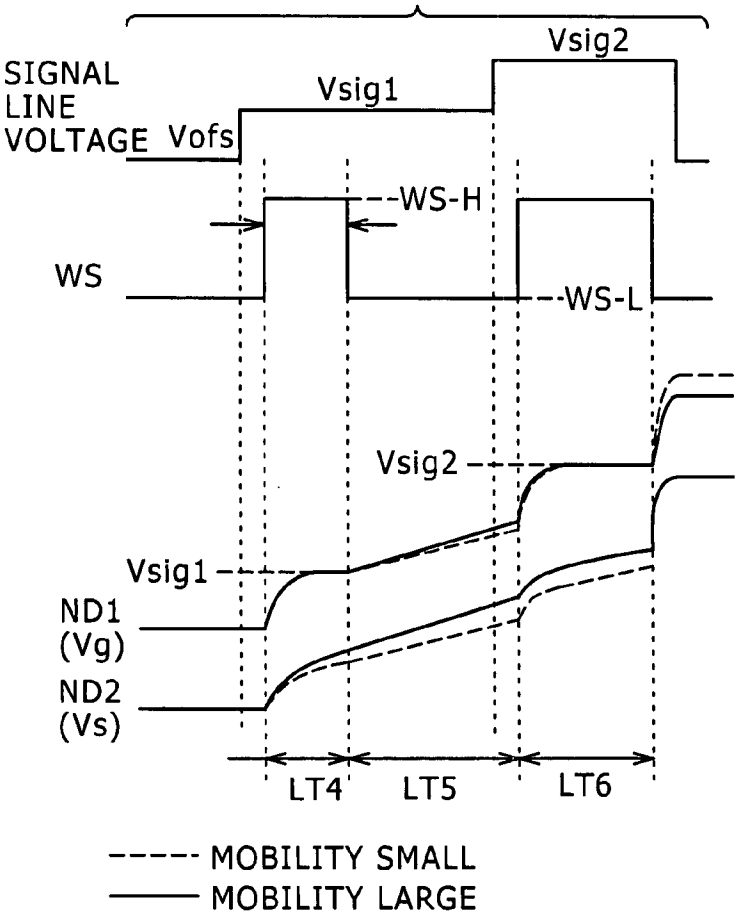
FIGS. 10A and 10B are timing charts explaining mobility correction in a second example of the first embodiment of the present invention, respectively.

A second example of the first embodiment will be described with reference to FIGS. 10A and 10B. FIG. 10A shows waveforms for the periods LT4, LT5 and LT6 of time in the comparative example described above similarly to the case of FIG. 9A. Also, FIG. 10B shows waveforms for the periods LT4, LT5 and LT6 of time in the second example.

In the case of the comparative example, as shown in FIG. 3 as well, the H level of the scanning pulse WS is fixed. Tentatively, the H level voltage of the scanning pulse WS is taken to be WS-H, and the L level voltage thereof is taken to be WS-L.

Figure 10B:
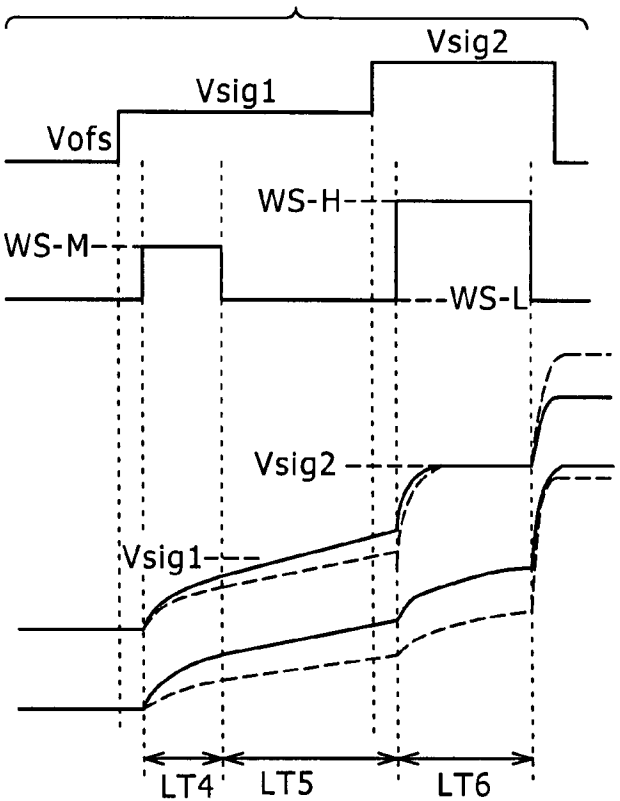

In the case of the second example, as shown in FIG. 10B, the voltage of the scanning pulse WS for formation of the period LT4 of time is set at WS-M lower than the normal H level voltage WS-H.

The H level voltage of the scanning pulse WS for the period LT6 of time for which the video signal voltage Vsig2 is written, and the H level voltage of the scanning pulse WS for the periods LT3*a*, LT3*b* and LT3*c* of time for the threshold correction although not shown in FIG. 10B are each set at WS-H.

It is noted that in the case of the second example of FIG. 10B, a time length of the period LT4 of time is the same as that in the case of the comparative example of FIG. 10A.

In the case of the second example, when the intermediate voltage Vsig1 is written, the H level voltage applied to the gate terminal of the sampling transistor Ts is lowered (voltage WS-H). The voltage WS-M in this case, in a word, the gate voltage of the sampling transistor Ts is set at such a voltage value that causes the sampling transistor Ts to conduct, but reduces the drain-to-source current of the sampling transistor Ts, and thus prevents the voltage at the node ND1 from reaching the intermediate voltage Vsig1 at a time point of end of the period LT4 of time.

In a word, the gate voltage of the sampling transistor Ts is set as such a voltage that causes lack in write of the intermediate voltage Vsig1 to the node Nd1.

In this case as well, similarly to the case of the first example described above, it is possible to further increase the difference in bootstrap amount between the case of the large mobility μ and the case of the small mobility μ in the bootstrapping operation for the period LT5 of time.

As a result, in the pixel circuit 10 having the large mobility μ, the bootstrap amount becomes large and the effective write voltage in the phase of write of the video signal voltage Vsig2 becomes smaller. On the other hand, in the pixel circuit 10 having the small mobility p, the bootstrap amount becomes small and the effective write voltage in the phase of write of the video signal voltage Vsig2 becomes larger. As a result, the final currents caused to flow through the respective organic EL elements 1 can be made equal to one another irrespective of small and large of the mobility μ.

Therefore, in the second example as well, the mobility correcting function can be enhanced without increasing the intermediate voltage Vsig1, thereby not causing an increase in power consumption.

Although the first embodiment, and the first and second examples of the first embodiment have been described so far, the present invention is by no means limited thereto.

The configuration of the pixel circuit 10 is by no means limited to the configuration shown in FIG. 2. The present invention can be applied to any other suitable display device as long as it adopts the circuit configuration and the driving system for carrying out the threshold correction and the mobility correction.

In addition, although in FIG. 8, the example is given in which the threshold correction is fractionally carried out three times, an example is also given in which the threshold correction is fractionally carried out twice or four times or more, or an example is also given in which the threshold correction is carried out once without being fractionally carried out.

In addition, a combination of the first and second embodiments is also supposed. That is to say, this example is such that the H level voltage of the scanning pulse WS for writing of the intermediate voltage Vsig1 is lowered and shortened.

5. Second Embodiment

Display Driving Method for Display Device

A display driving method for the display device according to a second embodiment of the present invention includes the steps of: causing the sampling transistor Ts to conduct while the signal line voltage is set as the reference voltage Vofs in order to cause the correction of the threshold Vth of the driving transistor Td to be carried out for the non-emission period of time within one emission cycle of the pixel circuit 10; and keeping the sampling transistor Ts in the non-conduction state for a given period of time after the sampling transistor Ts is controlled while the signal line voltage is set as the intermediate voltage Vsig1 in order to cause the input of the video signal voltage Vsig2 to the pixel circuit 10, and the correction of the mobility p of the driving transistor Td to be carried out after the correction of the threshold Vth, thereby boosting the gate voltage of the driving transistor Td from the reference voltage Vofs to the level not reaching the intermediate voltage Vsig1, and then causing the sampling transistor Ts to conduct while the signal line voltage is set as the video signal voltage Vsig2 in accordance with the scanning pulse WS outputted from the write scanner 13.

The present application contains subject matter related to that disclosed in Japanese Priority Patent Application JP 2010-147228 filed in the Japan Patent Office on Jun. 29, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device, comprising:

a pixel array in which pixel circuits each having a light emitting element, a driving transistor for applying a current corresponding to a gate-to-source voltage to said light emitting element connected to a source side by applying a drive voltage across a drain and a source, a sampling transistor for inputting a signal line voltage to a gate of said driving transistor by being caused to conduct, and a sustaining capacitor connected between said gate and said source of said driving transistor for sustaining a video signal voltage inputted thereto are disposed in a matrix;

a signal selector for supplying a reference voltage, an intermediate voltage, and a video signal voltage as the signal line voltage to each of signal lines disposed in said pixel array in columns in a time division manner;

a drive control scanner for giving a power source pulse to each of power source control lines disposed on said pixel array in rows, and applying a drive voltage to said driving transistor of said pixel circuit; and a write scanner for giving a scanning pulse to each of write control lines disposed on said pixel array in rows to control said sampling transistor of said pixel circuit, thereby causing input of the signal line voltage to said pixel circuit to be carried out, wherein for control within one emission cycle of said pixel circuit based on the scanning pulse, said write scanner causes said sampling transistor to conduct while the signal line voltage is set as the reference voltage in order to cause correction of a threshold of said driving transistor to be carried out for a non-emission period of time within the one emission cycle, controls said sampling transistor while the signal line voltage is set as the intermediate voltage in order to cause input of the video signal voltage to said pixel circuit and correction of a mobility of said driving transistor to be carried out after the correction of the threshold, thereby boosting a gate voltage of said driving transistor from the reference voltage up to a level not reaching the intermediate voltage, keeps said sampling transistor in a non-conduction state for a given period of time, and causes said sampling transistor to conduct while the signal line voltage is set as the video signal voltage.

2. The display device according to claim 1, wherein when the signal line voltage is held as the intermediate voltage, said write scanner outputs a scanning pulse in accordance with which said sampling transistor is caused to conduct, and said sampling transistor is set in a non-conduction state at a timing at which the gate voltage of said driving transistor does not reach the intermediate voltage.

3. The display device according to claim 1, wherein said write scanner causes the scanning pulse applied to said sampling transistor when the signal line voltage is held as the intermediate voltage to be a pulse having a lower voltage than that of the scanning pulse applied to said sampling transistor when the video signal voltage is inputted.

4. A display device, comprising:

a pixel array in which pixel circuits each having a light emitting element, a driving transistor for applying a current to said light emitting element, and a sampling transistor are disposed in a matrix;

a signal selector for supplying a reference voltage, an intermediate voltage and a video signal voltage as a signal line voltage to each of signal lines disposed on said pixel array in a time division manner; and a write scanner for controlling said sampling transistor of said pixel circuit, wherein said write scanner causes said sampling transistor to conduct while the signal line voltage is set as the reference voltage, causes said sampling transistor to conduct while the signal line voltage is set as the intermediate voltage, keeps said sampling transistor in a non-conduction state, and causes said sampling transistor to conduct while the signal line voltage is set as the video signal voltage.

5. A display driving method for a display device including:

a pixel array in which pixel circuits each having a light emitting element, a driving transistor for applying a current corresponding to a gate-to-source voltage to said light emitting element connected to a source side by applying a drive voltage across a drain and a source, a sampling transistor for inputting a signal line voltage to a gate of said driving transistor by being caused to conduct, and a sustaining capacitor connected between said gate and said source of said driving transistor for sustaining a video signal voltage inputted thereto are disposed in a matrix;

a signal selector for supplying a reference voltage, an intermediate voltage, and a video signal voltage as the signal line voltage to each of signal lines disposed on said pixel array in columns in a time division manner;

a drive control scanner for giving a power source pulse to each of power source control lines disposed on said pixel array in rows, and applying a drive voltage to said driving transistor of said pixel circuit; and a write scanner for giving a scanning pulse to each of write control lines disposed on said pixel array in rows to control said sampling transistor of said pixel circuit, thereby causing out input of the signal line voltage to said pixel circuit to be carried out, said display driving method comprising the steps of:

causing said sampling transistor to conduct while the signal line voltage is set as the reference voltage in order to cause correction of a threshold of said driving transistor to be carried out for a non-emission period of time within one emission cycle of said pixel circuit; and keeping said sampling transistor in a non-conduction state for a given period of time after said sampling transistor is controlled while the signal line voltage is set as the intermediate voltage in order to cause input of the video signal voltage to said pixel circuit, and correction of a mobility of said driving transistor to be carried out after correction of the threshold, thereby boosting a gate voltage of said driving transistor from the reference voltage to a level not reaching the intermediate voltage, and then causing said sampling transistor to conduct while the signal line voltage is set as the video signal voltage in accordance with a scanning pulse outputted from said write scanner.

* * * * *